United States Patent [19]

Moertel

[11] 4,276,679

[45] Jul. 7, 1981

[54] SLIDE FASTENER

[75] Inventor: George B. Moertel, Conneautville, Pa.

[73] Assignee: Textron, Inc., Providence, R.I.

[21] Appl. No.: 24,221

[22] Filed: Mar. 26, 1979

[51] Int. Cl.[3] ..... A44B 19/42

[52] U.S. Cl. ..... 24/205.16 R; 24/205.1 R;205.13 R

[58] Field of Search ..... 24/205.16 C, 205.16 R, 24/205.1 R, 205.13 R

[56] References Cited

U.S. PATENT DOCUMENTS

| | | | |
|---|---|---|---|
| 2,651,092 | 9/1953 | Poux | 24/205.16 R |
| 3,905,072 | 9/1975 | Hasegawa et al. | 24/205.16 R |
| 3,908,241 | 9/1975 | Moertel | 24/205.16 C |
| 3,977,053 | 8/1976 | Takamatsu | 24/205.16 R |
| 4,004,327 | 1/1977 | Fukuroi et al. | 24/205.16 R X |
| 4,134,353 | 1/1979 | Warburton et al. | 24/205.16 R X |
| 4,140,157 | 2/1979 | Scott | 24/205.16 R X |

FOREIGN PATENT DOCUMENTS

| | | | |
|---|---|---|---|
| 2356150 | 6/1974 | Fed. Rep. of Germany | 24/205.16 C |

*Primary Examiner*—Roy D. Frazier
*Assistant Examiner*—Peter A. Aschenbrenner
*Attorney, Agent, or Firm*—O'Brien and Marks

[57] ABSTRACT

A slide fastener is disclosed in which a plurality of thermoplastic coupling elements are each individually secured to ribs on a pair of mounting tapes. A raised attachment boss is formed on the interior of the leg portions of each coupling element with the attachment bosses each being ultrasonically fused to the ribs on the mounting tapes.

9 Claims, 5 Drawing Figures

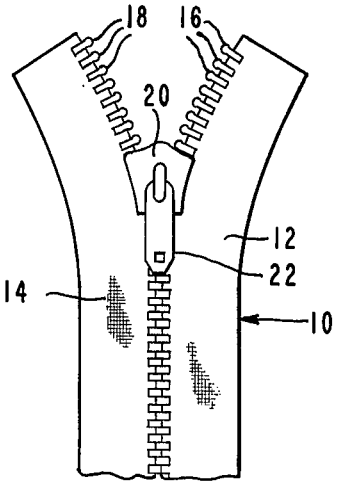
FIG. 1
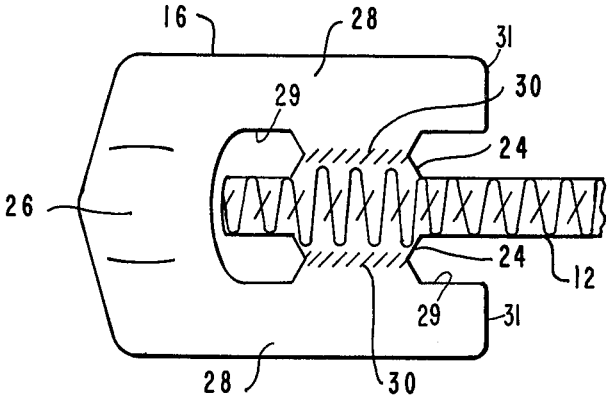
FIG. 2
FIG. 3
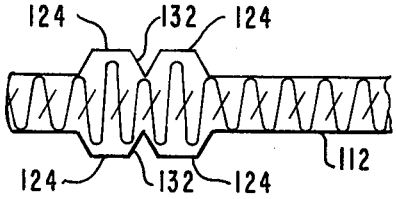
FIG. 4
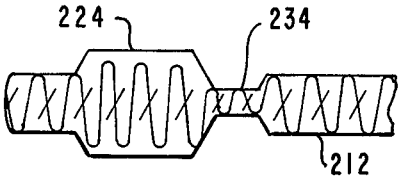
FIG. 5
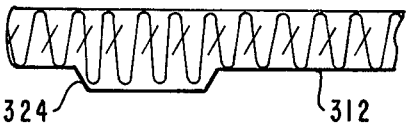

SLIDE FASTENER

BACKGROUND OF THE INVENTION

1. Field of the Invention

The present invention relates to slide fasteners in general and, in particular, to slide fasteners in which the coupling elements are each individually attached to a mounting tape.

2. Description of the Prior Art

The prior art is generally cognizant of the use of ultrasonic bonding in the manufacture of slide fasteners. Examples of the use of such bonding may be found in U.S. Pats. No. 3,440,117, No. 3,813,459, No. 3,874,963 and No. 3,885,273. U.S. Pat. No. 3,885,273 also shows a continuous slide fastener coupling element having bumps formed thereon. The prior art is also generally cognizant of the use of ribbed mounting tapes in slide fasteners for various other purposes. Examples of the use of ribbed mounting tapes are shown in U.S. Pats. No. 3,885,276 and 3,900,928.

SUMMARY OF THE INVENTION

The present invention is summarized in that a slide fastener includes a pair of mounting tapes having adjacent side edges, a plurality of thermoplastic coupling elements mounted on the adjacent edge of each of the coupling elements, each of the coupling elements including a head portion with a pair of leg portions extending therefrom on opposite sides of the respective mounting tapes, a thickened rib formed on at least one side of each of the mounting tapes near the adjacent edge thereof, and a raised attachment boss formed on the interior of each of the leg portions of the coupling elements, the attachment bosses being fused to the rib so that the coupling elements are securely attached to the respective mounting tapes.

It is an object of the present invention to construct a slide fastener in which the fastener is light and flexible and yet in which the coupling elements are securely fixed to the mounting tapes.

It is another object of the present invention to construct such a slide fastener in an efficient and economical manner.

Other objects, advantages and features of the present invention will become apparent from the following specification when taken in conjunction with the accompanying drawings.

BRIEF DESCRIPTION OF THE DRAWINGS

FIG. 1 is a front elevation view of a slide fastener constructed in accordance with the present invention.

FIG. 2 is a cross-sectional view of a mounting tape with coupling elements thereon from the slide fastener of FIG. 1.

FIG. 3 is a cross-sectional view of an alternative embodiment of a mounting tape usable in the slide fastener of FIG. 1.

FIG. 4 is a cross-sectional view of another alternative embodiment of a mounting tape usable in the slide fastener of FIG. 1.

FIG. 5 is a cross-sectional view of yet another alternative embodiment of a mounting tape usable in the slide fastener of FIG. 1.

DESCRIPTION OF THE PREFERRED EMBODIMENT

Shown in FIG. 1 is a slide fastener, generally indicated at 10, constructed in accordance with the present invention. The slide fastener 10 generally includes a pair of mounting tapes 12 and 14 located with a one of each of their longitudinal side edges adjacent the other one of the mounting tapes. Along the adjacent side edges of the mounting tapes 12 and 14 a plurality of thermoplastic slide fastener coupling elements 16 and 18 are provided with the coupling elements 16 on the mounting tape 12 being selectively engageable with the coupling elements 18 on the mounting tape 14. A slider 20 is entrained on the coupling element 16 and 18 and is movable upward or downward along the coupling elements 16 and 18 to selectively engage and disengage the coupling elements. A pull tab 22 is secured to the slider 20 so that it may be easily operated.

Shown in FIG. 2 is a cross-sectional view taken through the mounting tape 12 of the slide fastener 10 showing one of the coupling elements 16 mounted thereon. It is to be understood that the mounting tape 14 with the coupling elements 18 mounted thereon is generally similar and complementary to the mounting tape 12 with the coupling elements 16 mounted thereon. The mounting tape 12 has formed in it, near its edge upon which the coupling elements 16 are mounted, a thickened rib 24 formed as a thickened portion of the weave or knit of the mounting tape 12 itself. The rib 24 is spaced from the extreme edge of the mounting tape 12 by a distance approximately equal to the thickness of the remainder of the mounting tape 12. The rib 24 extends equal distances outward from both sides of the mounting tape 12 and is tapered at both of its edges.

As can also be seen in FIG. 2, each of the coupling elements 16 includes a head portion 26 which is formed with suitable protrusions thereon so as to be interengageable with a pair of similar head portions 26 on a pair of the coupling elements 18. From the head portion 26 a pair of leg portions 28 extned linearly outward with one of the leg portions 18 being disposed on each side of the mounting tape 12. Interior straight surfaces 29 of the leg portions 18 extend parallel the non-ribbed portion of the tape 12 from the head portion 26 to heels 31 of the leg portions 28. On the interior side or surface 29 of each of the leg portions 28 a raised attachment boss 30 is formed spaced apart from the head 26 and the heel 31. Each of the attachement bosses 30 on each of the coupling elements 16 is fused to the material of the respective upper or lower face of the rib 24 on the mounting tape 12. While it is envisioned within the scope of the present invention that the coupling elements 16 may be secured to the rib 24 on the mounting tape 12 by adhesive bonding or some other manner of heat sealing, it is preferred that the attachment bosses 30 are fused to the rib 24 on the mounting tape 12 by ultrasonic bonding. Ths ultrasonic bonding fuses the thermoplastic material of the coupling element 16 directly into the material of the mounting tape 12.

In constructing the slide fastener 10, the mounting tapes 12 and 14 are first constructed, either by weaving or by knitting, with the rib 24 being integrally constructed into each of the mounting tapes 12 and 14 during the construction. The coupling elements 16 and 18 are each individually molded in a separate operation. The coupling elements 16 and 18 are then fitted over the edges of the mounting tapes 12 and 14 with the attachment bosses 30 of all of the coupling elements being aligned over the ribs 24 on each of the mounting tapes 12 and 14. A suitable source of ultrasonic energy is then used to apply ultrasonic energy to each of the coupling elements 16 adn 18 with the energy being concentrated on the leg portions 28 of each of the coupling elements. The attachment bosses 30 focuses the ultrasonic energy at the contact surface between the attachment bosses 30 and the ribs 24 to fuse the material of the bosses 30 and the ribs 24 together in an integral and secure connection.

The slide fastener 10 offers several significant advantages over the prior art devices. It is a continuing object in the art of designing slide fasteners to construct such fasteners that are as light and flexible as possible while remaining as strong and secure as possible. The most critical component of the slide fastener in determining its overall strength to lateral stress is coventionally the connection f the coupling elements to the mounting tapes. The slide fastener of the presnt invention allows the mounting tapes to be thinner and more flexible than was heretofor possible. Yet the slide fastener of the present invention also ensures a secure connection between the coupling elements and the mounting tapes. The thickened ribs 24 add greater strength of the mounting tapes 12 and 14 in the area of the coupling elements 16 and 18. The fusing of the attachment bosses 30 to the ribs 24 securely fuses the coupling elements onto the mounting tapes. This integral fusing of the thermoplastic material of the coupling elements into the fabric of the ribs of the coupling elements more securely than any sewing or other simple physical connection is capable of doing. Furthermore the attachment bosses 30 ensure that the ultrasonic energy is focused at the area of attachment so that the overall shape of the coupling elements themselves is not affected.

Shown in FIGS. 3–5 are three alternative embodiments of the mounting tapes for use in the slide fastener of the present invention. FIG. 3 shows a mounting tape 112 having a rib formed on both sides of its adjacent to its edge. The rib 124 is bifurcated through its center by a locating groove 132. The locating groove 132 serves to aid in the positioning of the attachment bosses 30 of the coupling elements 16 and 18 as they are positioned over the rib 124 during the process of their attachment to the mounting tape 112.

FIG. 4 shows a mounting tape 212 also having a rib 224 formed on both sides thereof adjacent its edge. Adjacent to the rib 224, a longitudinal recess 234 is formed in the mounting tape 212. The recess 234 is formed to receive the flange of some types of sliders which include such flanges to firmly press against the rear sides of the coupling elements to aid in their coupling.

Shown in FIG. 5 is a mounting tape 312 having a rib 324 formed only on one side thereof adjacent its edge. The rib 324 is formed only on one side of the tape 312 in order not to interfere with special sliders which are sometimes used in slide fasteners which are used where a smooth, feature-free side of the slide fastener is needed for cosmetic purposes.

Inasmuch as the present invention is subject to many variations, modifications, and changes in detail, it is intended that all material contined in the foregoing description or shown in the accompanying drawing be interpreted as illustrative, and not in a limiting sense.

I claim:

1. A slide fastener comprising a pair of mounting tapes having adjacent side edges;

a plurality of thermoplastic coupling elements mounted on the adjacent edge of each of the coupling elements, each of the coupling elements including a head portion with a pair of leg portions extending therefrom on opposite sides of the respective mounting tape;

a thickened rib formed on at least one side of each of the mounting tapes near the adjacent edge thereof;

said leg portions each having a heel and a straight interior surface extending from adjacent the respective head portion to the respective heel; and a raised attachment boss formed on the interior surface of each of the leg portions of the coupling elements, the attachment bosses being spaced apart from the respective head portions and the respective heels and being fused to the respective ribs so that the coupling elements are securely attached to the respective mounting tapes.

2. A slide fastener as claimed in claim 1 wherein there is a rib on each side of each of the mounting tapes.

3. A slide fastener as claimed in claim 1 wherein each of the ribs is spaced from the edge of the respective mounting tape by a distance approximately equal to the thickness of the remainder of the mounting tape.

4. A slide fastener as claimed in claim 1 wherein each of the ribs has tapered edges.

5. A slide fastener as claimed in claim 1 wherein each of the ribs has a locating groove formed therein.

6. A slide fastener as claimed in claim 1 wherein a longitudinal recess is formed in each of the mounting tapes adjacent to the ribs therein.

7. A slide fastener as claimed in claim 1 wherein ultrasonic bonding secures the attachment bosses to the ribs on the mounting tapes.

8. A slide fastener as claimed in claim 1 wherein each of the mounting tapes is woven.

9. A slide fastener as claimed in claim 1 wherein each of the mounting tapes is knitted.

* * * * *